US006148603A

United States Patent [19]

Althaus

[11] Patent Number: 6,148,603

[45] Date of Patent: Nov. 21, 2000

[54] METHOD OF OPERATING A GAS-TURBINE-POWERED GENERATING SET USING LOW-CALORIFIC-VALUE FUEL

[75] Inventor: Rolf Althaus, Flawil, Switzerland

[73] Assignee: Asea Brown Boveri AG, Baden, Switzerland

[21] Appl. No.: 09/101,018

[22] PCT Filed: Dec. 16, 1996

[86] PCT No.: PCT/CH96/00441

§ 371 Date: Jun. 29, 1998

§ 102(e) Date: Jun. 29, 1998

[87] PCT Pub. No.: WO97/24561

PCT Pub. Date: Jul. 10, 1997

[30] Foreign Application Priority Data

Dec. 29, 1995 [DE] Germany ..... 195 49 140

[51] Int. Cl.[7] ..... F02C 7/26

[52] U.S. Cl. ..... 60/39.06; 60/39.465; 60/39.826

[58] Field of Search ..... 60/39.06, 39.141, 60/39.465, 39.826

[56] References Cited

U.S. PATENT DOCUMENTS

| | | | |
|---|---|---|---|
| 4,202,169 | 5/1980 | Acheson et al. . | |
| 4,253,301 | 3/1981 | Vogt . | |
| 4,653,278 | 3/1987 | Vinson et al. . | |
| 4,890,453 | 1/1990 | Iwai et al. | 60/39.465 |
| 5,129,221 | 7/1992 | Walker et al. | 60/39.06 |
| 5,451,160 | 9/1995 | Becker . | |
| 5,907,949 | 6/1999 | Falke et al. | 60/39.06 X |

FOREIGN PATENT DOCUMENTS

| | | |
|---|---|---|
| 1137266 | 9/1962 | Germany . |
| 101457 | 11/1973 | Germany . |
| 1317727 | 5/1973 | United Kingdom . |

*Primary Examiner*—Timothy S. Thorpe
*Assistant Examiner*—Ehud Gartenberg
*Attorney, Agent, or Firm*—Burns, Doane, Swecker & Mathis, L.L.P.

[57] ABSTRACT

In a method of operating a gas turbine group with low calorific value fuel, the gas turbine group essentially comprises a compressor, a combustion chamber, a turbine and a generator. The low calorific value fuel is compressed by means of a fuel compressor. Low calorific value fuel (11*a*) in excess of the stoichiometric quantity is mixed into part of the combustion air (9, 9*a*) during the starting of the gas turbine group so that a stable flame appears. After the attainment of the rated rotational speed (B) and synchronization, at the latest, the quantity of low calorific value fuel (11*a*) is reduced to such an extent that a ratio is attained which is just over the stoichiometric ratio. The rest of the low calorific value fuel (11*b*) is mixed into the rest of the combustion airflow (9*a*, 9*b*) in order to attain the desired load.

4 Claims, 3 Drawing Sheets

METHOD OF OPERATING A GAS-TURBINE-POWERED GENERATING SET USING LOW-CALORIFIC-VALUE FUEL

BACKGROUND OF THE INVENTION

1. Field of the Invention

The invention relates to a method of operating a gas turbine group with low calorific value fuel, whereby the gas turbine group essentially comprises a compressor, a combustion chamber, a turbine and a generator and whereby the low calorific value fuel is compressed by means of a fuel compressor.

2. Discussion of Background

Such methods are known. In contrast to gas turbines which are operated with conventional medium calorific value or high calorific value fuels, such as natural gas or oil with a calorific value of 40 MJ/kg or more, the stabilization of the combustion represents a problem in the case of gas turbines which use a low calorific value fuel with a calorific value of an order of value below 10 MJ/kg. In the particular case of calorific values below 3 MJ/kg (approximately 700 kcal/$m_n^3$), the flame becomes unstable.

U.S. Pat. No. 5,451,160 describes a burner for the combustion of gases with the most varied calorific values. The burner contains an inner part, which acts as the pilot burner, and an outer main burner which concentrically surrounds the pilot burner. When the pilot burner and the main burner are operated with low calorific gases, however, the stability of the flame represents a problem and the danger of flame extinction exists.

SUMMARY OF THE INVENTION

Accordingly, one object of the invention is to provide a novel way of stabilizing the combustion of fuels of low calorific value in a method of operating a gas turbine group with low calorific value fuel.

This is achieved, in accordance with the invention, by means of the features of the first claim.

The core of the invention is therefore an arrangement wherein low calorific value fuel in excess of the stoichiometric quantity is mixed into part of the combustion air during the starting of the gas turbine group so that a stable flame appears, wherein after the attainment of the rated rotational speed and synchronization, at the latest, the quantity of low calorific value fuel is reduced to such an extent that a ratio is attained which is just over the stoichiometric ratio and wherein the rest of the low calorific value fuel is mixed into the rest of the combustion airflow in order to attain the desired load.

The advantages of the invention may, inter alia, be seen in the fact that the gas turbine group can essentially be operated exclusively with low calorific value fuel. By this means, the economy of gas turbines which are operated with low calorific value materials of the lowest calorific values is increased.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential to understanding the invention are shown.

DESCRIPTION OF THE PREFERRED EMBODIMENTS

Figure 1:
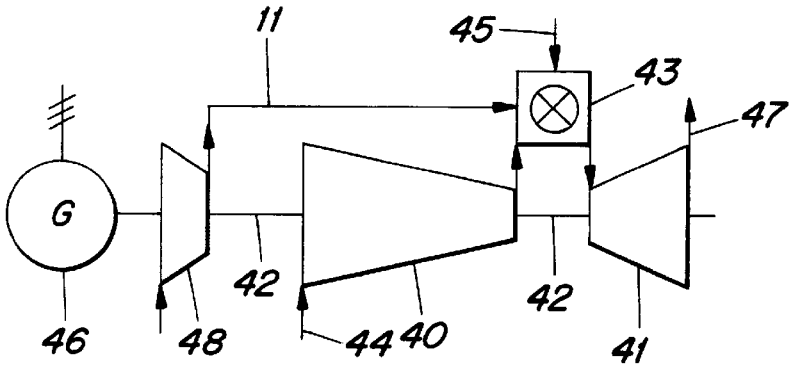
FIG. 1 shows a diagrammatic representation of a gas turbine group.

Referring now to the drawing, wherein like reference numerals designate identical or corresponding parts throughout the several views, FIG. 1 shows, diagrammatically, a gas turbine group which comprises essentially of a compressor 40, a gas turbine 41 and a generator 46, which are connected together by means of a shaft 42, and a combustion chamber 43 is diagrammatically shown. A fuel compressor 48 for compressing low calorific value, gaseous fuel is additionally provided between the compressor 40 and the generator 46. The compression of the fuel can also, of course, take place in any other given manner. In the compressor 40, air is induced via an air supply line 44 and compressed and the compressed air is guided into the combustion chamber 43. Fuel in the form of additional fuel 45 (pilot gas or liquid fuel) or in the form of compressed low calorific value fuel 11 is supplied to the combustion air at this location and the fuel/air mixture is burnt. The resulting combustion gases are introduced into the gas turbine 41, where they expand and part of the energy of the combustion gases is converted into rotational energy. This rotational energy is used, by means of the shaft 42, to drive the generator 46 and the compressor 40. The exhaust gases, which are still hot, are led away via a line 47.

Figure 2:
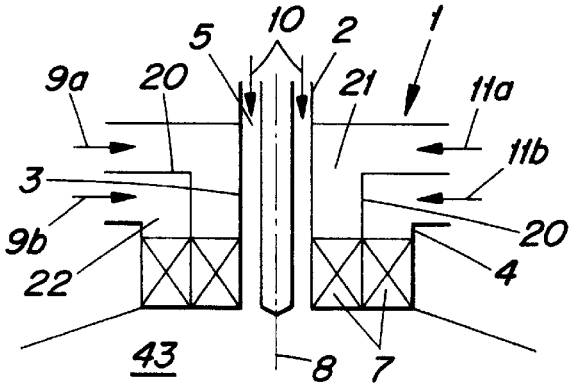
FIG. 2 shows a partial cross section through a burner of the gas turbine group.

According to FIG. 2, a burner 1 of the combustion chamber 43 essentially comprises a central fuel lance 2, an inner tube 3 and an outer tube 4, which are arranged concentrically about an axis of symmetry 8. A fuel nozzle (not shown in any more detail) for spraying in liquid fuel is provided at the downstream end of the fuel lance 2. The liquid fuel is then guided via the fuel lance to the fuel nozzle. An annular duct 5 is formed by the fuel lance 2 and the inner tube 3, and low calorific value gas, with which depending on its calorific value—high calorific value gas can be mixed, is introduced as pilot gas 10 via the annular duct 5 into the combustion chamber 43. An annular duct is formed by the inner tube 3 and the outer tube 4 and this annular duct is subdivided by a separating wall into an inner partial duct 21 and an outer partial duct 22. The ratio of the partial cross sections of the partial ducts 21, 22 can be adjusted by means of the radial position of the separating wall 20 so that the low calorific value fuel can likewise be correspondingly subdivided. The combustion air is likewise subdivided into two partial airflows 9*a* and 9*b* by the separating wall 20. A partial fuel flow 11*a* of the low calorific value fuel flows through the inner partial duct 21 and a partial fuel flow 11*b* of the low calorific value fuel flows through the outer partial duct 22. The partial flows 11*a*, 11*b* are regulated, in this arrangement, by different valves (not shown). Swirl bodies 7, which support the mixing of the fuel 10, 11 with the combustion air 9*a*, 9*b*, are provided at the downstream end of the duct 6.

Figure 3:
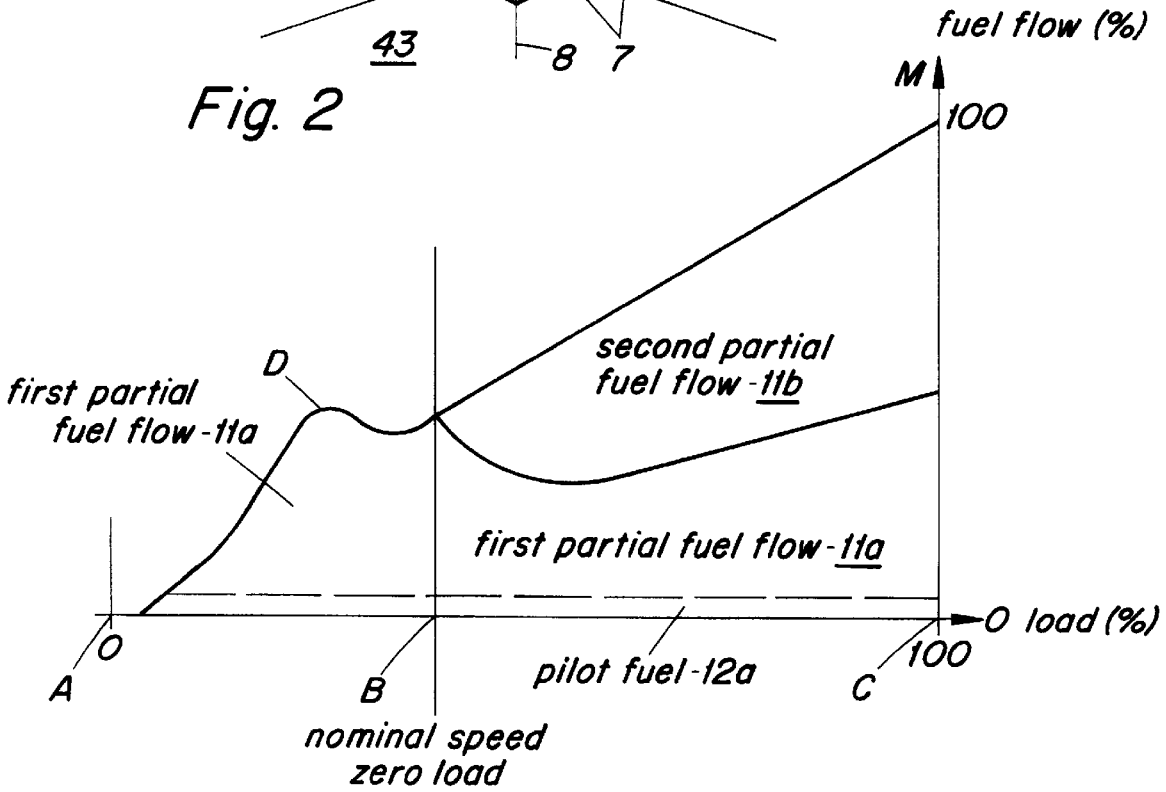
FIG. 3 shows a diagrammatic representation of the operating method of the gas turbine group.

The fuel quantity M is plotted as a percentage on the ordinate of FIG. 3. On the abscissa, the rotational speed is plotted from point A to point B and the load is plotted from point B to point C. The rotational speed is equal to zero at point A and increases to point B, at which the rated rotational speed is achieved, for example 3600 revolutions per minute for 60 Hertz.

In order to ensure reliable starting of the gas turbine group, the transient starting process is operated with low calorific value gas 11*a* which is supplied through the inner partial duct 21. Because a small quantity of air, i.e. a partial airflow 9*a* determined by the smaller cross section of the partial duct 21, is supplied to the low calorific value gas required for starting, a richer mixture and therefore stable combustion results. Because, in this case, it is also only relatively small valves (not shown) which have to be used to regulate the mass flow of the fuel (because of the relatively small partial duct cross sections), this also permits very rapid regulation and this, in turn, permits rapid temperature corrections. These temperature corrections produce the hump at point D. When the gas turbine group is run up, the system composed of the compressor 40 and the turbine 41 starts to convert the quantity of heat supplied in the combustion chamber 43 into power in the upper third of the rated rotational speed B. In consequence, the drive power of the generator 46, and therefore also the temperature in the combustion chamber 43, can be reduced and the result of this is a reduction in the quantity of the low calorific value fuel 11*a* at point D. At the rated rotational speed B, the system composed of the compressor 40 and the turbine 41 is then in thermal equilibrium.

After the rated rotational speed has been attained at point B, the synchronization of the gas turbine group takes place with the network into which the electrical energy produced in the generator 46 has to be fed.

The second partial fuel flow 11*b* of the low calorific value fuel is switched on via the outer partial duct 22 before or after synchronization. The fuel quantity in the first partial fuel flow 11*a* is then reduced to such an extent that a stable flame is maintained. In consequence, the difference between the fuel required for the load point selected and the fuel quantity in the first partial fuel flow 11*a* is a maximum. A maximum possible fuel quantity is therefore likewise available to the second partial fuel flow 11*b*, which leads to stable operation even when the outer burner partial duct 22 is switched on.

Between point B of zero load and point C of maximum load, the total quantity of the low calorific value fuel 11*a* and 11*b* is adjusted in a manner which is essentially linear with load.

For further stabilization of the flame generated with the low calorific value fuel 11*a* and 11*b* in the combustion chamber 43, additional fuel 12 can be sprayed into the center of the flame. This takes place by means of liquid fuel via the fuel lance 2 or by means of pilot gas 10 via the duct 5 of the burner. The quantity of fuel 12 is small and is generally below five percent of the fuel quantity supplied.

Figure 4:
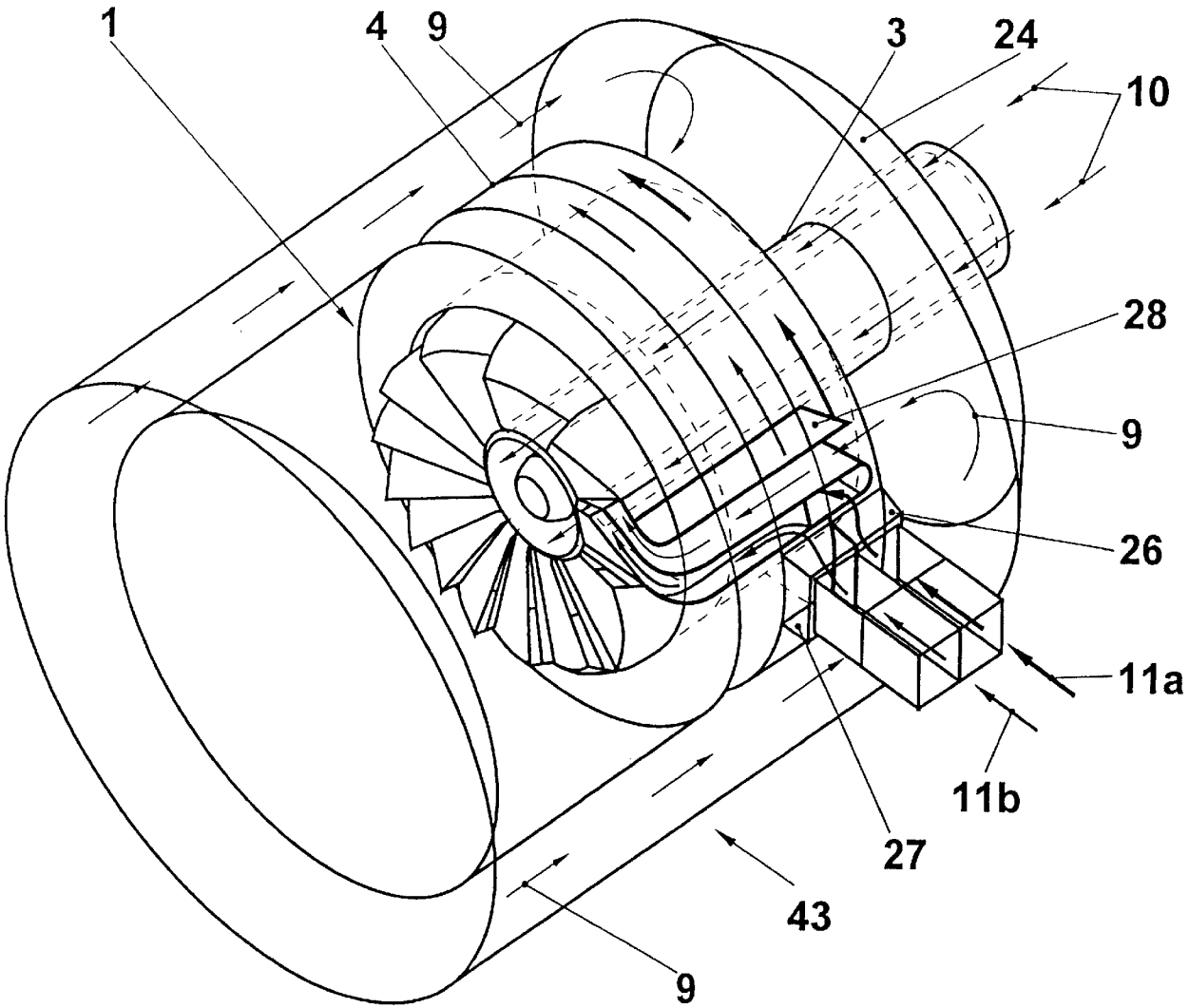
FIG. 4 shows a combustion chamber, with burner, of the gas turbine group.
Figure 5:
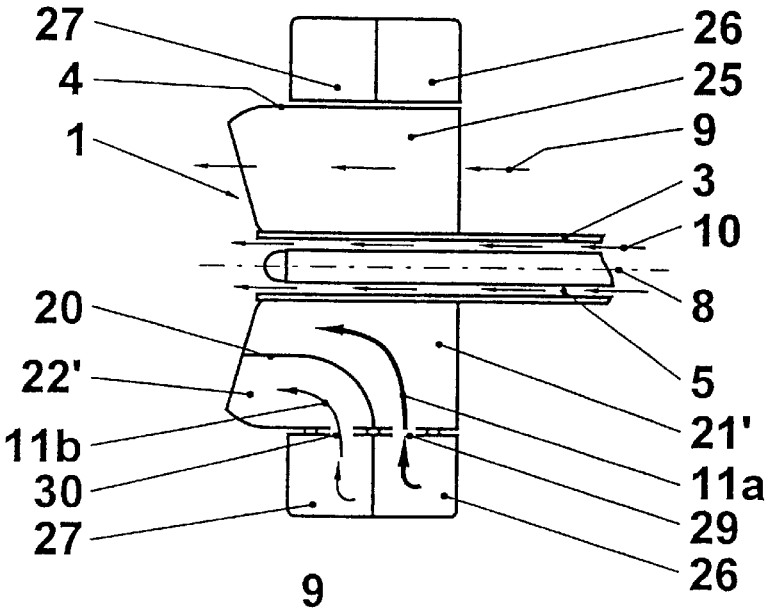
FIG. 5 shows a partial cross section through the burner of FIG. 4.
Figure 6:
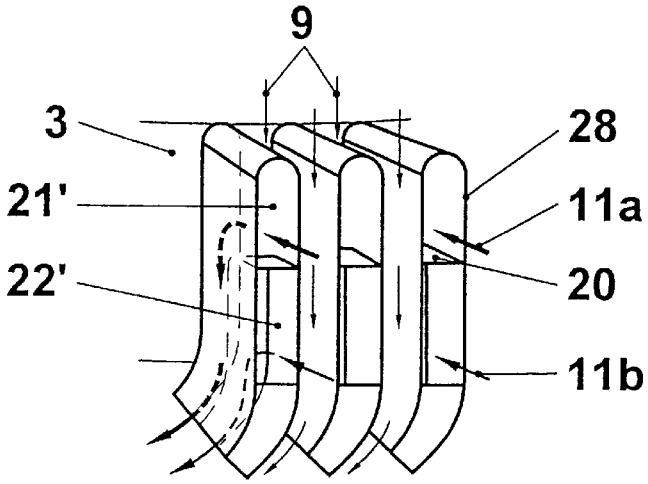
FIG. 6 shows a partial development of the burner of FIG. 4.
Figure 7:
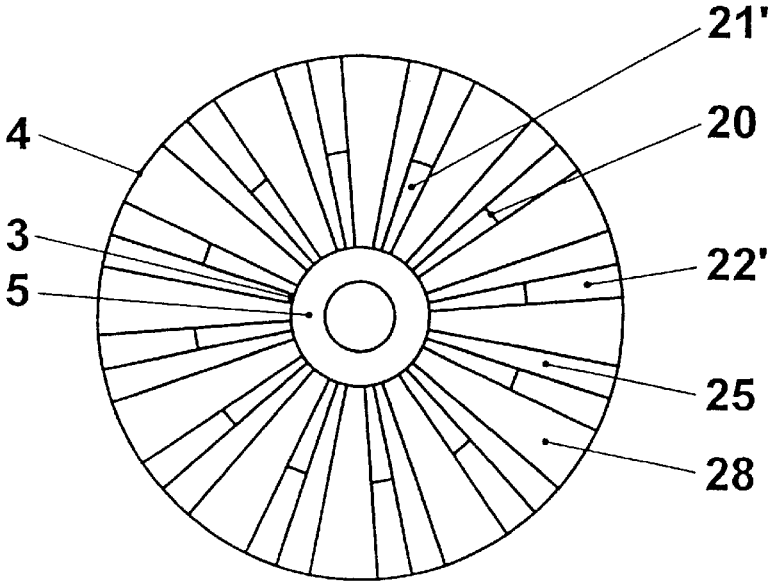
FIG. 7 shows a plan view from the combustion space onto the burner outlet.

In FIG. 4 and the further FIGS. 5, 6 and 7, the burner 1 is arranged within a combustion chamber 43. Combustion air 9 is guided into a dome 24 and is fed from there to the downstream end of the burner 1 via air ducts 25 extending in the flow direction. In contrast to FIG. 2, the air duct is not subdivided into an outer and an inner region in this case. In this case also, however, the burner 1 is subdivided in the flow direction into alternate radially extending air ducts 25 and fuel ducts 21', 22' by means of separating walls 28, the fuel ducts in turn being subdivided into annuli by the separating wall 20. The low calorific value gas 11*a* and 11*b* is guided around the burner by means of annular ducts 26 and 27, which surround the burner 1, and fed into the inner fuel duct 21' and the outer fuel duct 22' via openings 29, 30. The low calorific value fuel is then fed during starting and operation of the burner as described above. Although the combustion air is not subdivided into annuli in this case, the low calorific value gas 11*a* supplied through the inner partial duct 21 essentially mixes only with the combustion air in the center of the burner, as shown in FIG. 2. Because the low calorific value gas 11*a* only mixes with part of the combustion air 9, a richer mixture, and therefore stable combustion, results, at least in the center of the burner. A flame therefore appears in the center of the combustion space which is enveloped by combustion air 9 if no fuel 11*b* is supplied via the outer fuel duct 22'. In the case of the burner in FIG. 4, no swirl bodies 7 are provided. The mixing of the combustion air 9 and the fuel 11*a*, 11*b* takes place by means of a curvature of the separating wall 28 at the downstream end of the burner 1. A swirl, which mixes the fuel and the combustion air, is produced by this means on exiting the burner.

Obviously, numerous modifications and variations of the present invention are possible in light of the above teachings. A plurality of separating walls can also be installed in order to subdivide the partial ducts further.

LIST OF DESIGNATIONS

1 Burner
2 Burner lance
3 Inner tube
4 Outer tube
5 Duct for pilot gas
7 Swirl body
8 Axis of symmetry
9, 9*a*, 9*b* Combustion air
10 Pilot gas
11*a*, 11*b* Low calorific value gas
12 Fuel
20 Separating wall
21 Inner partial duct
21' Inner fuel duct
22 Outer partial duct
22' Outer fuel duct
23 Combustion chamber wall
24 Dome
25 Air duct
26 Annular duct for 11*a*
27 Annular duct for 11*b*
28 Separating wall
29 Opening from 26 to 21'
30 Opening from 27 to 22'
40 Compressor
41 Gas turbine
42 Shaft
43 Combustion chamber
44 Air supply line
45 Additional fuel
46 Generator
47 Exhaust gas line
48 Fuel compressor
A Rotational speed zero point
B Rated rotational speed/zero load point
C Full load
D Apex point

What is claimed as new and desired to be secured by Letters Patent of the United States is:

1. A method of operating a gas turbine group with low calorific value fuel, whereby the gas turbine group essentially comprises a compressor (40), a combustion chamber (43), a turbine (41) and a generator (46) and whereby the low calorific value fuel is compressed by means of a fuel compressor (48), wherein low calorific value fuel (11*a*) in excess of the stoichiometric quantity is mixed into part of the combustion air (9, 9*a*) during the starting of the gas turbine group so that a stable flame appears, wherein after the attainment of the rated rotational speed (B) and synchronization, at the latest, the quantity of low calorific value fuel (11*a*) is reduced to such an extent that a ratio is attained which is just over the stoichiometric ratio and wherein the rest of the low calorific value fuel (11*b*) is mixed into the rest of the combustion airflow (9, 9*b*) in order to attain the desired load.

2. The method as claimed in claim 1, wherein fuel (12) is sprayed into the center of the combustion air (9, 9*a*).

3. The method as claimed in claim 1, wherein the combustion air is subdivided into at least two partial airflows (9*a*, 9*b*) before entry into the combustion chamber.

4. The method as claimed in claim 1, wherein the first partial airflow (9*a*) is surrounded by the second partial airflow (9*b*).

* * * * *